US005203478A

United States Patent [19]

de Laforcade et al.

[11] Patent Number: 5,203,478

[45] Date of Patent: Apr. 20, 1993

[54] DISPENSER ASSEMBLY FOR A FLUID PRODUCT COMPRISING A DEVICE HAVING A TWIN LEVER ARM IN ORDER TO ACTUATE A DISPENSING MEANS

[75] Inventors: Vincent de Laforcade, Clamart; Gilles Baudin, Clichy, both of France

[73] Assignee: L'Oreal, Paris, France

[21] Appl. No.: 770,405

[22] Filed: Oct. 3, 1991

[30] Foreign Application Priority Data

Oct. 15, 1990 [FR] France ..... 90 12689

[51] Int. Cl.[5] ..... B65D 83/18

[52] U.S. Cl. ..... 222/402.13; 222/402.15

[58] Field of Search ..... 222/402.1, 402.13, 402.15, 222/509

[56] References Cited

U.S. PATENT DOCUMENTS

| | | | |
|---|---|---|---|
| 2,558,272 | 6/1951 | Rubenstein et al. | 222/402.15 |
| 2,941,700 | 6/1960 | Gable | 222/509 X |
| 3,361,301 | 1/1968 | Meshberg | 222/402.13 X |
| 3,404,814 | 6/1967 | Wakeman | 222/402.13 |
| 3,407,975 | 10/1968 | Schroeder | 222/402.13 |
| 3,429,484 | 2/1969 | Baldwin | 222/509 |
| 3,933,283 | 1/1976 | Hoagland | 222/400.13 |
| 4,024,995 | 5/1977 | Landen et al. | 222/402.11 |
| 4,773,571 | 9/1988 | Hagan et al. | 222/402.15 X |
| 4,863,074 | 9/1989 | Quennessen | 222/402.13 |

FOREIGN PATENT DOCUMENTS

| | | | |
|---|---|---|---|
| 836915 | 3/1970 | Canada | 222/402.15 |
| 0227510 | 1/1987 | European Pat. Off. . | |
| 402636 | 12/1990 | European Pat. Off. | 222/402.13 |

*Primary Examiner*—Andres Kashnikow
*Assistant Examiner*—Kenneth Bomberg
*Attorney, Agent, or Firm*—Cushman, Darby & Cushman

[57] ABSTRACT

In the device (1) according to the invention, the lever arm actuating the valve consists of an element (5) disposed symmetrically on either side of the push-button against which it presses by means of a projection (24). The small plate (5) has four catches (25*a*, 25*b*, 25*c*, 25*d*) each sliding in a channel formed in a guide means (16*a*, 16*b*, 16*c*, 16*d*) carried by the fixed part (4) of the distributor head parallel to the longitudinal axis of the assembly. When one end (23*a*) of the small plate (5) is pressed, the two catches (25*a*, 25*d*) slide downwards in their channels and the other two catches (25*b*, 25*c*) remain in the abutting position at the top of their associated channels.

12 Claims, 3 Drawing Sheets

DISPENSER ASSEMBLY FOR A FLUID PRODUCT COMPRISING A DEVICE HAVING A TWIN LEVER ARM IN ORDER TO ACTUATE A DISPENSING MEANS

BACKGROUND OF THE INVENTION

Description of the Prior Art

This invention relates to a dispenser assembly for a fluid product, provided with a device having a twin lever arm in order to actuate the means for dispensing the product.

Numerous dispensers for a fluid product, in liquid or pasty form, are known, consisting of a container containing the substance to be dispensed, the said container being provided with a dispensing means for delivery of the product and having a distributor head fixed to the container by interlocking, snap engagement or screwing. The said head comprises a push-button to be pressed by the user in order to dispense the product through the opening of the dispensing means. In the known manner, the assembly may either be of the "aerosol" type, containing a propellant, or of the "pump" type, the dispensing means being respectively a valve or a mechanical hand pump.

Attempts are being made, particularly in the cosmetic industry, to develop dispensers giving the user greater flexibility, ease and convenience of use. It is well known to facilitate dispensing using a device having a lever arm in order to actuate the dispensing means. In order to mount a lever arm device, it is necessary, particularly when the assembly has a circular shape in transverse section, to add a handle, thereby increasing the overall dimensions.

It should be noted that, in the case of the assemblies in question, the product is generally dispensed laterally, perpendicularly to the longitudinal axis of the assembly. When the assembly has an elliptical shape in transverse section, dispensing is effected perpendicularly to the major axis of the ellipse, as for reasons of cleanliness, the dispensing orifice for the product must always be situated at a point close to an edge of the container, so that the droplets of the sprayed product do not dirty the container. Moreover, it is often necessary to decentre the neck of the container in order to place it on the end of the minor axis of the ellipse, which may disturb the flow of the product to be dispensed. When attempting to design an assembly in which the dispensing means is situated on its longitudinal axis, in which the jet of the dispensed product is perpendicular to the major axis of the transverse section of the container, and which is provided with a device having a lever arm in order to actuate the dispensing means, a problem is encountered as a result of the fact that these assemblies cannot be used as easily by left-handed persons as by right-handed persons. If the lever arm is disposed to the right of the valve, a right-handed person will naturally use the index finger, but a left-handed person will have to use the thumb, which is neither natural nor easy.

SUMMARY OF THE INVENTION

Therefore, the object of this invention is to provide a dispenser assembly for a fluid product, comprising a dispensing means disposed on the longitudinal axis of the said assembly, in which the spray jet is substantially perpendicular to the major axis of the ellipse if the assembly has an elliptical shape in transverse section, and in which a device having a twin lever arm is used in order to actuate the dispensing means for the product, wherein this device can be used just as easily by left-handed persons as by right-handed persons. This problem is solved by using an element of symmetrical shape as the twin lever arm, said element being guided parallel to the longitudinal axis of the container by a system comprising catches fixed to the said element. These catches are displaced in recessed channels in the guide means parallel to the said longitudinal axis disposed symmetrically relative to the said longitudinal axis. The said element can pivot alternately about the two parallel axes passing through the upper ends of two channels.

Therefore, the object of this invention is a dispenser assembly for a fluid product, provided with a device having a lever arm in order to actuate the dispensing means for the said product, this assembly consisting, on the one hand, of a container provided with a dispensing means situated on the longitudinal axis of the said assembly and actuated by means of a push-button provided with a lateral dispensing orifice for the fluid product and, on the other hand, of a distributor head fixed to the said container, the said head comprising a fixed part and a movable part having the device for actuating the dispensing means by pressing the said push-button, characterised firstly in that the fixed part of the distributor head comprises a zone in which an opening is formed for the sliding of the push-button and which has, on the side opposite the container, guide means in which four channels are formed, disposed symmetrically relative to two perpendicular planes containing the longitudinal axis, secondly, that the movable part consists of an element forming a twin lever arm, the longitudinal axis of which is situated in a first plane of symmetry of the channels, the said element having four catches disposed so that they can each slide into a channel, a projection projecting below the element and being disposed so that it can rest on the upper surface of the push-button at a point situated on the longitudinal axis of the assembly, and thirdly, that the dispensing orifice for emitting a jet of product is situated in the second plane of symmetry of the channels.

When the assembly has an elliptical shape in transverse section, the first plane of symmetry of the channels contains the major axis of the ellipse and the second plane the minor axis of the ellipse. In other words, the longitudinal axis of the element forming the lever arm is parallel to the major axis of the ellipse and the jet of the dispensed product is parallel to the minor axis of the ellipse.

The guide means preferably consist of four pillars, each pillar comprising a channel. They may also advantageously consist of a continuous wall having two channels and of two pillars, the continuous wall, when it is opposite the dispensing orifice, being provided with an opening for the passage of the jet of the dispensed product. They may also consist of two continuous walls, the wall opposite the dispensing orifice being provided with an opening for the passage of the jet of the dispensed product. By virtue of these different variations, it is possible to change the aesthetic appearance of the assembly.

The element may consist, e.g. of a rod. It preferably consists of a small plate which may have a planar or curved surface.

The operation of this assembly is as follows. In the rest position, the four catches are in an abutting position in the channels of the guide means. When the user presses part of the element situated towards the exterior beyond the guide means, the element presses against the push-button by means of its projection, resulting in dispensing of the product. Simultaneously, two of the catches fixed to the element slide towards the container in the two channels situated at the side pressed, the other two catches still abutting against the ends of the other two channels. As the device for actuating the valve is completely symmetrical, the user can obtain the same result by pressing with the index finger of the right hand on the right-hand portion of the element and with the index finger of the left hand on the left-hand portion of the element.

The upper surface of the push-button is preferably dish-shaped so as to maintain better contact between the projection and the upper surface of the push-button during operation of the apparatus.

The push-button preferably comprises a groove which cooperates with a rib integral with the zone of the fixed part in order to prevent rotation of the push-button relative to the plate. The rib preferably projects over the edge of the opening. It should be noted that other antirotation devices could be used.

The element advantageously consists of a small plate comprising a narrower centre portion which is disposed between the channels and, at either end of the centre portion, two wider portions to be pressed by the user. The maximu length of the small plate is preferably equal to the diameter of the container when the container is a cylinder having a circular section or to the larger axis when the container is a cylinder having an elliptical section. In this manner, the small plate does not extend beyond the assembly and so does not increase its overall dimensions.

The catches are preferably disposed so that they project out from the lateral edge of the small plate, preferably in its narrow portion. Each catch advantageously consists of a wedge which is connected via its tip to the small plate by means of a film hinge, the tip of the wedge being directed towards the face of the small plate having the projection, the said wedge being capable of disappearing into a notch formed in the edge of the small plate. In this manner, when the catch is inserted into the corresponding channel of a guide means, the catch enters into the notch when it is not opposite the channel, then opens by the elasticity of the film hinge when it is opposite the channel, the wedge shape preventing the catch from coming out of the channel.

The central zone of the upper face having the guide means is advantageously a plate carried by the fixed part of the distributor head, the said fixed part consisting of a cap provided with a cylindrical skirt for fixing the distributor head to the container by snap engagement, screwing, or any other appropriate means.

BRIEF DESCRIPTION OF THE DRAWINGS

The invention will be more readily understood from the following description of an assembly according to the invention, given purely by way of a non-limiting example and with reference to the accompanying drawings, in which.

DETAILED DESCRIPTION OF THE INVENTION

Figure 1:
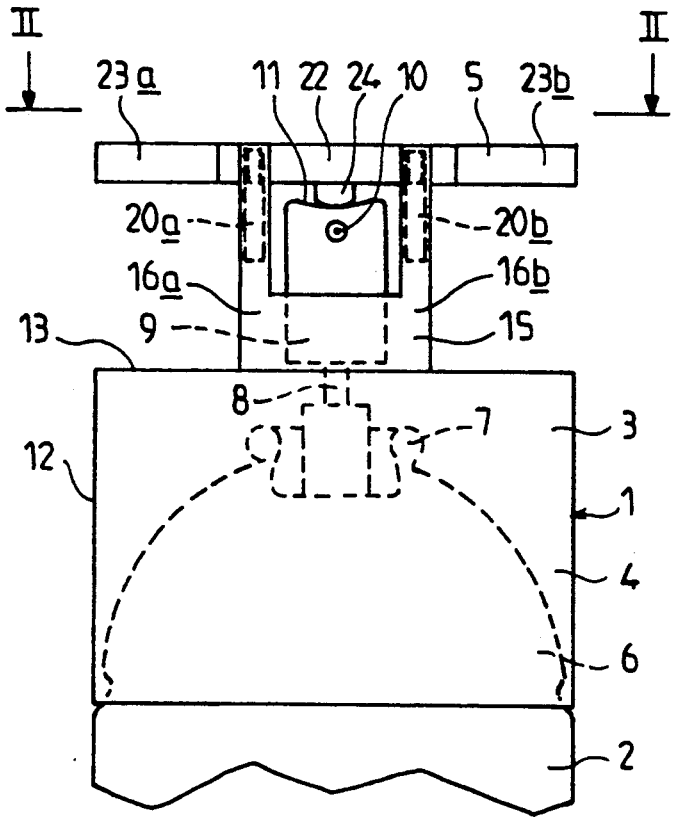
FIG. 1 is a partial elevation of an assembly according to the invention.
Figure 2:
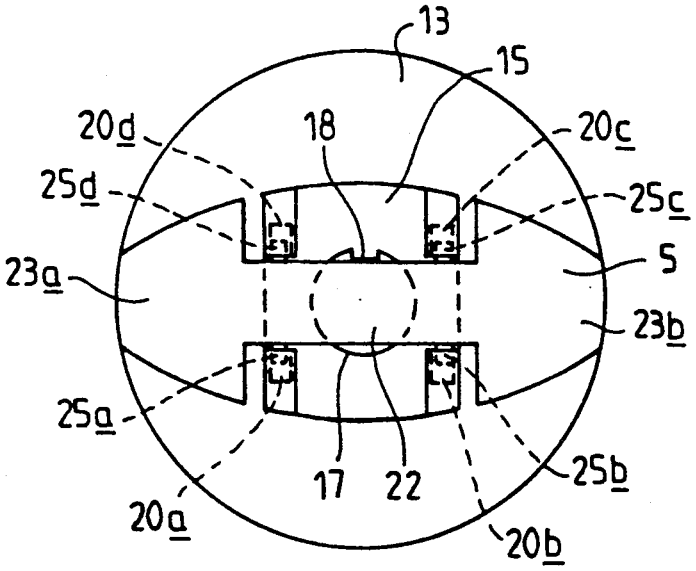
FIG. 2 is a top view along the line II—II of FIG. 1.
Figure 3:
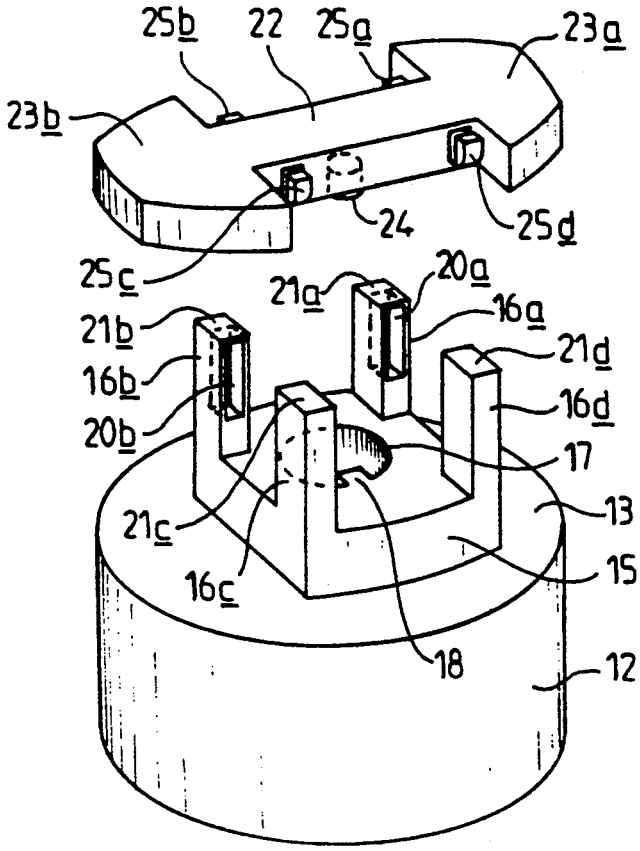
FIG. 3 is an exploded perspective of the distributor head of the assembly of FIG. 1.

As illustrated in FIG. 1, the assembly 1 according to the invention consists of a pressurised container 2, a distributor head 3 comprising a fixed part 4 and a movable part 5 being fixed thereto by snap engagement.

Figure 5:
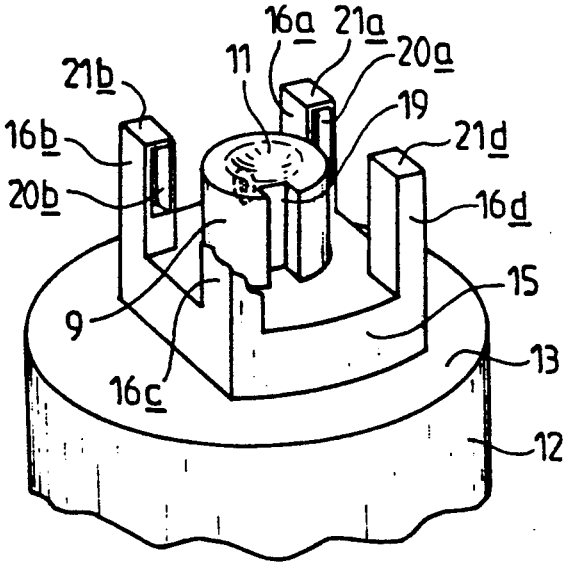
FIG. 5 is a perspective of the fixed part of the distributor head after mounting of the push-button.

The container 2 illustrated partially in FIG. 1 consists of a cylindrical part having a circular transverse section closed at one end by a base (not shown) and at the other end by a dome 6 having in its upper part a valve cup fixed by a crimp 7. The valve cup is provided in its centre with a valve, the projecting stem of which is designated by the reference numeral 8. A push-button 9 of cylindrical shape is locked on to the stem 8. The dispensing orifice 10 for the fluid product opens on to the lateral cylindrical wall of the push-button 9. The upper surface 11 of the push-button 9 is dish-shaped, the base of the dish being on the container side. A groove 19 (FIG. 5) is formed in the lateral wall of the push-button 9, this groove being diametrically opposite the orifice 10.

The fixed part 4 of the distributor head 3 consists of a cap, comprising a cylindrical skirt 12 fixed by snap engagement to the container 2 and an upper face 13 perpendicular to the axis of the skirt 12. A square plate 15 is formed in the central zone of the upper face 13, provided at each of its four corners with a pillar **16*a*, 16*b*, 16*c*, 16*d* and provided in its centre with an opening 17 having an inner diameter equal, except for the necessary clearance, to the outer diameter of the push-button 9. The edge of the opening 17 is provided with a rib 18 which is capable of cooperating with the groove 19 of the push-button 9. The pillars 16*a*, 16*b*, 16*c*, 16*d* are each provided with a recessed channel 20*a*, 20*b*, 20*c*, 20*d*. These channels are disposed symmetrically in pairs relative to the plane passing through the axis of the assembly and perpendicular to the axial plane containing the orifice 10 and the rib 18. The channel 20*a* is opposite the channel 20*d* and the channel 20*b* is opposite the channel 20*c*. The channels 20*a*, 20*b*, 20*c*, 20*d* are closed in their upper parts (in the position illustrated in the different figures) by a wall perpendicular to the longitudinal axis of the assembly forming stops 21*a*, 21*b*, 21*c*, 21*d***.

The movable part 5 of the distributor head 3 consists of a small plate having the general shape of a dumb-bell. This small plate comprises a narrower portion 22 connecting two widened portions **23*a* and 23*b*. The narrower portion is provided in its centre, on its face directed towards the container, with a projection 24 which, when the part 5 is in position, rests in the dish of the upper surface 11 of the push-button 9. Catches 25*a*, 25*b*, 25*c*, 25*d* are disposed on the lateral edge of the narrower portion 22 so that they can penetrate into the channels 20*a*, 20*b*, 20*c* and 20*d*** respectively.

Figure 4:
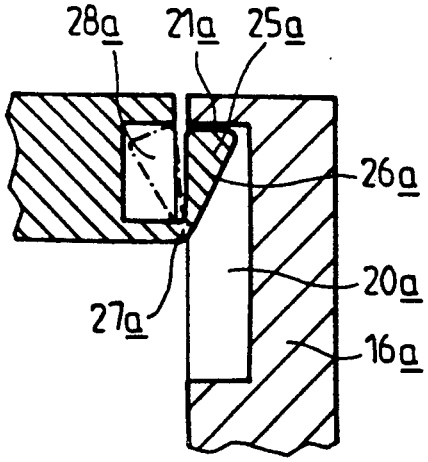
FIG. 4 is a detail, in section, of a catch.

The catch **25*a* is shown in more detail in FIG. 4. It consists of a wedge-shaped component 26*a*, the lower tip of which is connected by a film hinge 27*a* to the lower part of a parallelepipedal notch 28*a* formed in the edge of the small plate. The film hinge 27*a* is fixed to the tip of the wedge and the notch 28*a* has dimensions such that the wedge 26***a* can disappear into the said notch 28*a*. The film hinges are constructed of a flexible material so as to act as pivot points to accommodate a slight twisting or bending of the catch elements. Thus, when the movable part 5 is pivoted, the horizontal plane distance between the catches remains constant, and the catches remain within the channels. The catches 25*a*, 25*b*, 25*c*, 25*d* can be obtained by moulding with the small plate 5.

According to the embodiment illustrated, the outer edges of the rounded ends of the small plate 5 are in the shape of the arc of a circle, so that they do not extend beyond the skirt 12. The longitudinal axis of the small plate 5 is perpendicular to the plane connecting the groove of the push-button to the dispensing orifice. The Jet of the dispensed product is therefore perpendicular to the longitudinal axis of the small plate 5.

The assembly 1 operates in the manner described hereinafter. When no dispensing is taking place (see FIG. 1) the push-button 9 is in the upper position and the the small plate 5 is perpendicular to the longitudinal axis of the assembly 1, the catches 25*a*, 25*b*, 25*c*, 25*d* all abutting against the stops 21*a*, 21*b*, 21*c*, 21*d* respectively.

Figure 6:
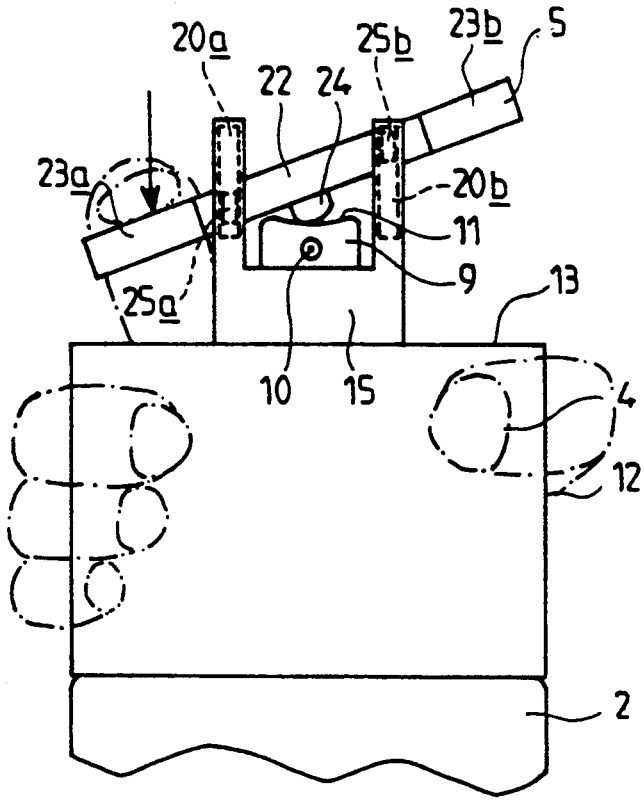
FIGS. 6 and 7 are diagrammatic views of the assembly according to the invention actuated by a right-handed person (FIG. 6) or by a left-handed person (FIG. 7).

When the user wishes to dispense the product, working with his right hand, he takes the assembly in his hand and presses with the index finger of the right hand on the widened portion 23*a* (see FIG. 6). The small plate 5 is inclined by virtue of the sliding of the catches 25*a* and 25*d* into the channels 20*a* and 20*d* respectively. The projection 24 presses against the push-button 9 and depresses the latter, resulting in dispensing of the product contained in the container 2 through the opening of the valve. The catches 25*b* and 25*c* still abut against the walls 21*b* and 21*c* respectively. Therefore, it is as if the small plate were turning about an axis passing through the catches 25*b* and 25*c*. During dispensing, as the push-button 9 slides into the opening 17 formed in the plate 15, the rib 18 slides into the groove 19 and guides the push-button 9 preventing it from rotating relative to the plate. The position of the spray orifice 10 relative to the pillars 16*a* and 16*b* is maintained in this manner. When the user stops pressing on the small plate, the push-button 9 returns to its upper position under the action of the valve spring and returns the small plate 5 to its initial position.

Figure 7:
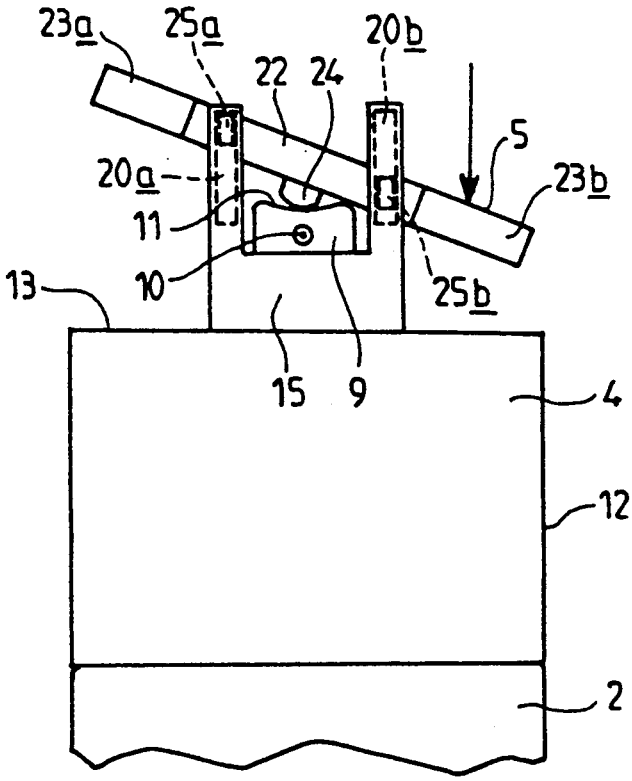

When the user works with his left hand, he presses with the left index finger on the widened portion 23*b* and inclines the small plate in the opposite direction, so that the catches 25*b* and 25*c* slide into the channels 20*b* and 20*c*, the catches 25*a* and 25*d* remaining in the abutting position. The movement is absolutely symmetrical (see FIG. 7).

We claim:

1. A dispenser assembly for a fluid product housed in a container having a longitudinal axis and of the type having a dispensing means including a movable member disposed along the longitudinal axis of the container and a push button having a dispensing orifice and mounted on the movable member so as to be movable between an actuated and a deactuated position to, respectively, dispense the product through the dispensing orifice and to cease dispensing of the product, said dispenser assembly comprising a stationary part for mounting on the container and a part movably mounted on said stationary part to move the push button from the deactuated to the actuated position, said stationary part including an opening for slidably receiving the push button, guide means on said stationary part for guiding the movement of said movably mounted part, said guide means having four channels disposed symmetrically relative to the longitudinal axis of the container when the stationary part is mounted on the container, said movably mounted part comprising a lever arm having a longitudinal axis and opposite ends, said lever arm having four catch elements each slidably received in one of said channels, said lever arm further including a projection member for engaging the push button.

2. The invention as claimed in claim 1 wherein each said channel is located in a pillar extending from said stationary part.

3. The invention as claimed in claim 1 wherein said guide means comprises wall means including two pillars, each of said pillars having one of said channels located therein, an opening being provided between said pillars for allowing the dispensing of the product from said dispensing orifice.

4. The invention as claimed in claim 1 wherein said guide means comprises two wall means, each of said wall means including two pillars with one of said channels being disposed in each of said pillars, one of said wall means being adjacent said dispensing orifice and including an opening for the passage of the dispensed product.

5. The invention as claimed in claim 1 wherein said lever arm is a flat plate.

6. The invention as claimed in claim 1 wherein said push button has a top surface which is dish shaped.

7. The invention as claimed in claim 6 wherein said push button has a side surface provided with a longitudinal groove and said opening in said stationary part having a rib engaging in said groove.

8. The invention as claimed in claim 7 wherein said opening in said stationary part has an upper edge and said rib extends into said opening at said upper edge.

9. The invention as claimed in claim 2 wherein said lever arm is a plate having a central portion with a selected width and opposite ends which are each formed with a width greater than said selected width, said central portion being disposed between said pillars and said ends of said plate being disposed externally of said pillars.

10. The invention as claimed in claim 9 wherein said plate has lateral edges extending between said ends and said catch elements extend from said lateral edges.

11. The invention as claimed in claim 10 wherein each said catch element is wedged shaped with a narrow tip and a base wider than said respective tip, each said tip being connected to said plate with a film hinge and with each said tip pointing generally toward said stationary part of said dispenser assembly, each respective said lateral edge of said plate having a recess into which a respective said catch element is movable.

12. The invention as claimed in claim 3 wherein said wall means is a plate carried by said stationary part, said stationary part comprising a cap having a cylindrical skirt for attachment to the container.

* * * * *